US010142720B1

(12) United States Patent
Wallace et al.

(10) Patent No.: US 10,142,720 B1
(45) Date of Patent: Nov. 27, 2018

(54) HEADPHONES WITH EXTERNAL PRESSURE EQUALIZATION PATH

(71) Applicant: Bose Corporation, Framingham, MA (US)

(72) Inventors: Eric M. Wallace, Andover, MA (US); Daniel K. Lee, Framingham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/597,567

(22) Filed: May 17, 2017

(51) Int. Cl.
*H04R 1/10* (2006.01)

(52) U.S. Cl.
CPC ..... *H04R 1/1016* (2013.01); *H04R 1/1075* (2013.01); *H04R 2460/09* (2013.01); *H04R 2460/11* (2013.01)

(58) Field of Classification Search
CPC ..... H04R 1/1016; H04R 1/1075; H04R 2460/11; H04R 2460/09
USPC ..... 381/380
See application file for complete search history.

(56) References Cited

U.S. PATENT DOCUMENTS 5,729,605 A * 3/1998 Bobisuthi ..... H04R 1/1041 379/430
6,683,965 B1 * 1/2004 Sapiejewski ..... H04R 1/1083 381/370
7,784,583 B1 * 8/2010 Hall ..... H04R 1/1016 181/130
7,916,888 B2 * 3/2011 Sapiejewski ..... H04R 1/288 381/370
8,189,846 B2 * 5/2012 Tiscareno ..... H04R 1/1016 381/322
8,355,522 B2 1/2013 Annunziato et al.
8,594,351 B2 * 11/2013 Harlow ..... H04R 1/1016 381/309
8,670,586 B1 3/2014 Boyle et al.
8,755,550 B2 6/2014 Monahan et al.
9,131,311 B2 * 9/2015 Lumsden ..... H04R 1/1016
9,215,522 B2 12/2015 Monahan et al.
9,237,394 B2 * 1/2016 Seo ..... H04R 1/1016
9,301,040 B2 3/2016 Annunziato et al.
9,438,989 B2 * 9/2016 Chu ..... H04R 1/2811
9,794,681 B2 10/2017 Annunziato et al.
9,794,700 B2 * 10/2017 Saltykov ..... H04R 25/48
2010/0061580 A1 3/2010 Tiscareno et al.
2010/0166245 A1 * 7/2010 Takigawa ..... H04R 1/1041 381/380
2013/0148830 A1 6/2013 Sakaguchi et al.
(Continued)

FOREIGN PATENT DOCUMENTS

JP 2013229728 A 11/2013

OTHER PUBLICATIONS

International Search Report and Written Opinion dated Jul. 23, 2018 for International application No. PCT/US2018/033108.

*Primary Examiner* — Oyesola C Ojo

(57) ABSTRACT

An earphone includes a housing enclosing an acoustic transducer and having a front volume. The housing includes a nozzle that extends the front volume to at least an entrance of a wearer's ear canal, and a groove in an outer surface of the housing, extending at least along a length of the nozzle. A flexible ear tip is configured to attach to the housing. When the flexible ear tip attaches to the housing, the groove and a portion of an inner surface of the ear tip together form a port that acoustically couples the front volume with an environment external to the earphone.

21 Claims, 7 Drawing Sheets

(56) References Cited

U.S. PATENT DOCUMENTS

2014/0363040 A1* 12/2014 Silvestri ..... H04R 1/1016
381/380
2015/0382099 A1* 12/2015 Chu ..... H04R 1/2811
381/370

* cited by examiner

HEADPHONES WITH EXTERNAL PRESSURE EQUALIZATION PATH

BACKGROUND

This disclosure relates to headphones, and in particular, headphones with an external pressure equalization path.

Devices that block the ear canal, such as headphones, hearing aids, and earplugs, tend to cause an amplification within the ear canal of low-frequency sounds originating from or passing through the body. This is referred to as the occlusion effect, and can be unpleasant. Many such devices relieve the discomfort of the occlusion effect by providing a vent or port connecting air inside the ear canal with outside air. This vent or port is sometimes referred to as a pressure equalization, or PEQ port. While it slightly compromises the ability of the device to block external noise, the relief a PEQ port provides from the occlusion effect can be worth the trade-off. These vents or ports, in prior solutions, have been provided as holes or tubes through the device. In headphones or hearing aids having a rigid inner electronics bud and an outer, flexible ear tip, PEQ ports have been provided as holes or tubes through the ear tip, through the inner bud, or both. At least one design, described in U.S. Pat. No. 8,189,846, provides the PEQ port as a groove on the inner, mating surface of the ear tip, with the outer surface of the ear bud closing the open side of the groove to form a tube when the ear tip is fitted to the ear bud.

SUMMARY

In general, in one aspect, an earphone includes an earphone body composed of rigid material and having an outer surface, the earphone body including an inner end and an outer end, such that when the earphone is located in an ear, the inner end is located near the ear canal and the outer end faces away from the ear. An ear tip is composed of flexible material and having an inner surface corresponding in shape to at least a portion of the outer surface of the earphone body, and an outer surface configured to contact the ear and seal the ear canal when the earphone is located in the ear. The ear tip covers the earphone body from a first point on the earphone body near the inner end of the earphone body to a second point on the earphone body near the outer end of the earphone body when the ear tip is positioned on the earphone body. The earphone body includes a groove in the outer surface extending from a first end at the first point on the earphone body to a second end at the second point on the earphone body, and having an open top between the ends, such that when the ear tip may be positioned on the earphone body, the groove and a portion of the ear tip inner surface facing the groove together form a hollow tube extending from the first point on the earphone body to the second point on the earphone body.

Implementations may include one or more of the following, in any combination. The first end of the groove may be located at the inner end of the earphone body. The second end of the groove may be located at the outer end of the earphone body. The groove may be about 0.35 mm wide. The groove may be about 0.3 mm deep. The groove may have a cross-sectional area of about 0.1 $mm^2$. The groove may be rectangular in cross section. The groove may have a length and width such that the tube formed when the groove is covered by the ear tip may have an acoustic impedance of around $3.9\times10^8$ $Pa\cdot s/m^3$ below 200 Hz, and increases linearly with frequency above 200 Hz. The groove may have an acoustic impedance of around $8.7\times10^8$ $Pa\cdot s/m^3$ at 1 kHz.

The ear tip may include an opening through which the outer end of the earphone body extends, and an edge of the ear tip surrounding the outer end of the earphone body may be rounded, such that a channel is formed between the ear tip and the earphone body, around a perimeter of the earphone body, the hollow tube formed between the groove and the inner surface of the ear tip ending in the channel. An electroacoustic transducer may be located inside the earphone body, a radiating surface of the transducer being acoustically coupled to a first opening at the inner end of the earphone body. A screen may cover the first opening at the inner end of the earphone body, and may extend over at least part of the first end of the groove. The first end of the groove may be located at the inner end of the earphone body. The screen may extend along the surface of the earphone body, covering the open top of the groove, for a first distance. The ear tip may include a second opening corresponding to the first opening in the earphone body, to allow sound produced by the transducer to exit the earphone.

In general, in some aspects, an earphone includes a housing enclosing an acoustic transducer and having a front volume. The housing includes a nozzle that extends the front volume to at least an entrance of a wearer's ear canal and a groove in an outer surface of the housing, extending at least along a length of the nozzle. A flexible ear tip is configured to attach to the housing. When the flexible ear tip attaches to the housing, the groove and a portion of an inner surface of the ear tip together form a port that acoustically couples the front volume with an environment external to the earphone.

Advantages include providing pressure equalization between the ear canal and the outside atmosphere without compromising the volume of the earphone, and with repeatable acoustic properties.

All examples and features mentioned above can be combined in any technically possible way. Other features and advantages will be apparent from the description and the claims.

DESCRIPTION

Figure 1:
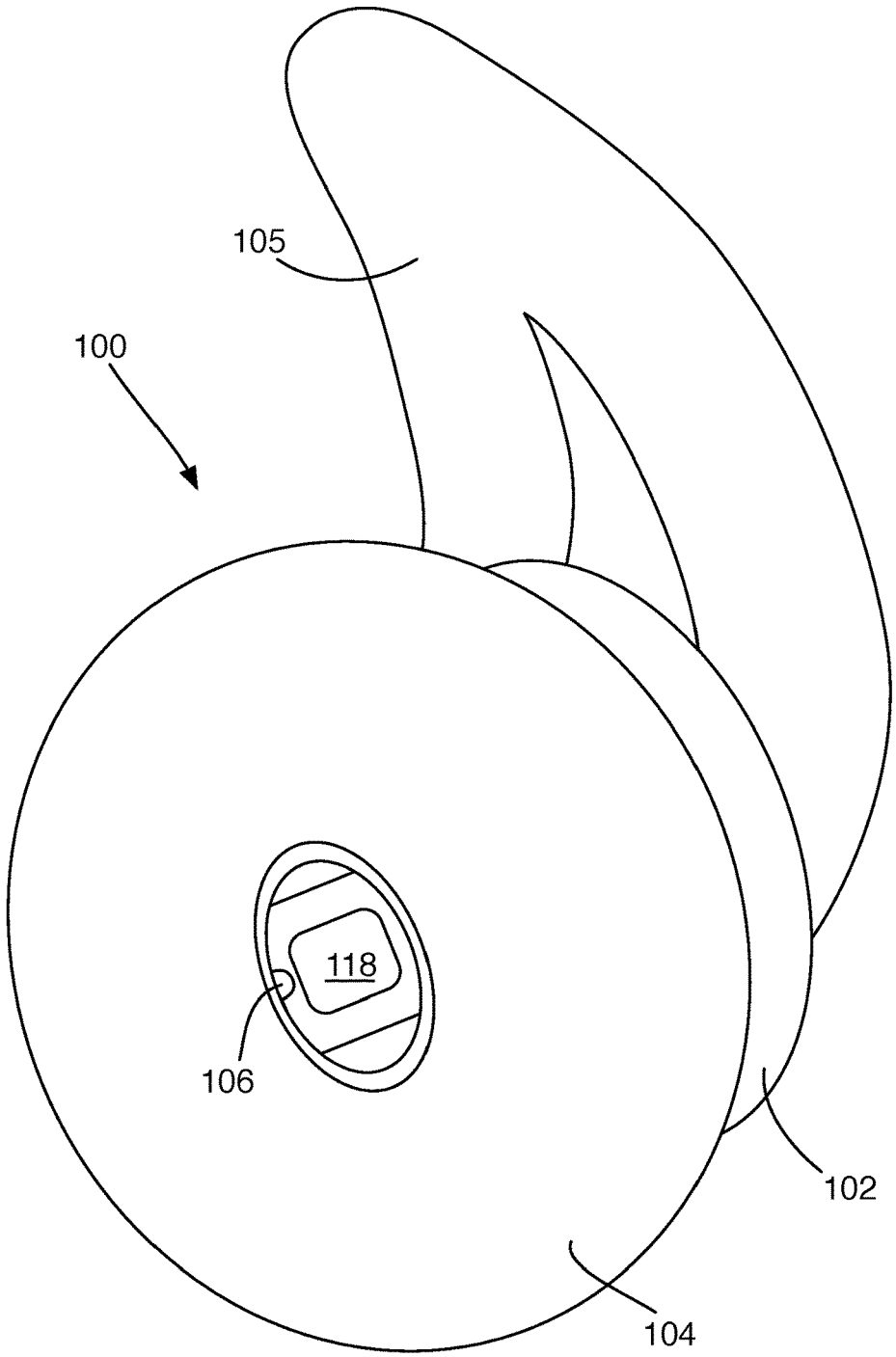
FIGS. 1 and 9 show perspective views of an earphone, from opposite sides.
Figure 2:
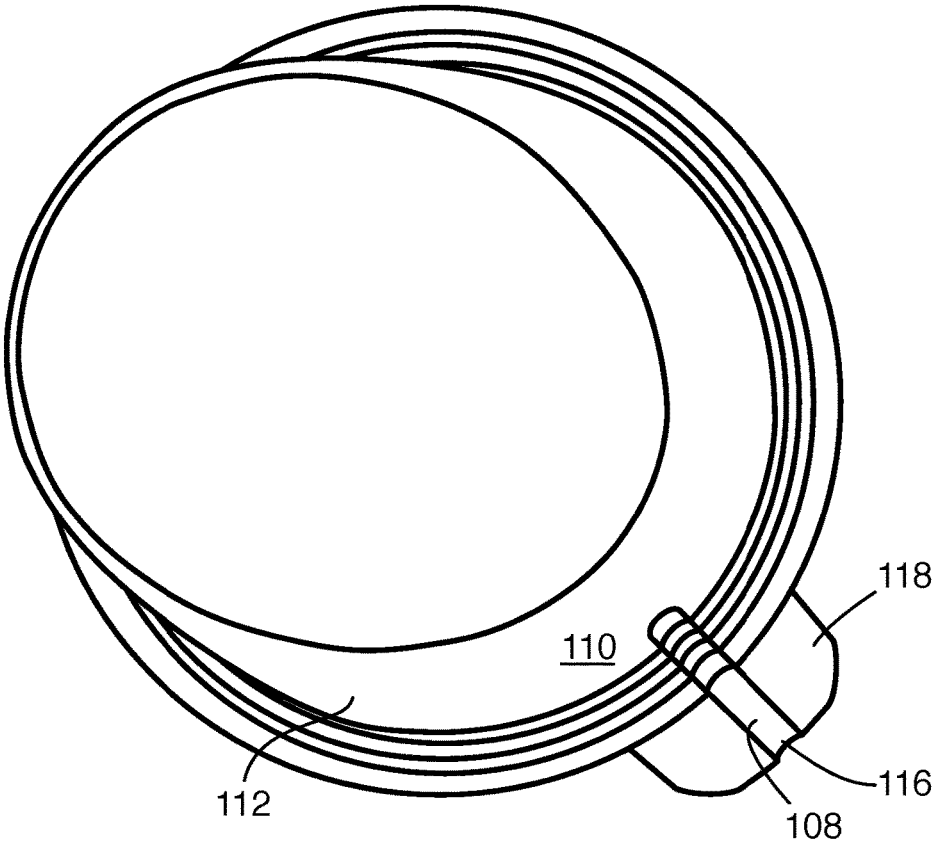
FIG. 2 shows a perspective view of an inner body of the earphone of FIG. 1, from the other side than the view of FIG. 1.
Figure 3:
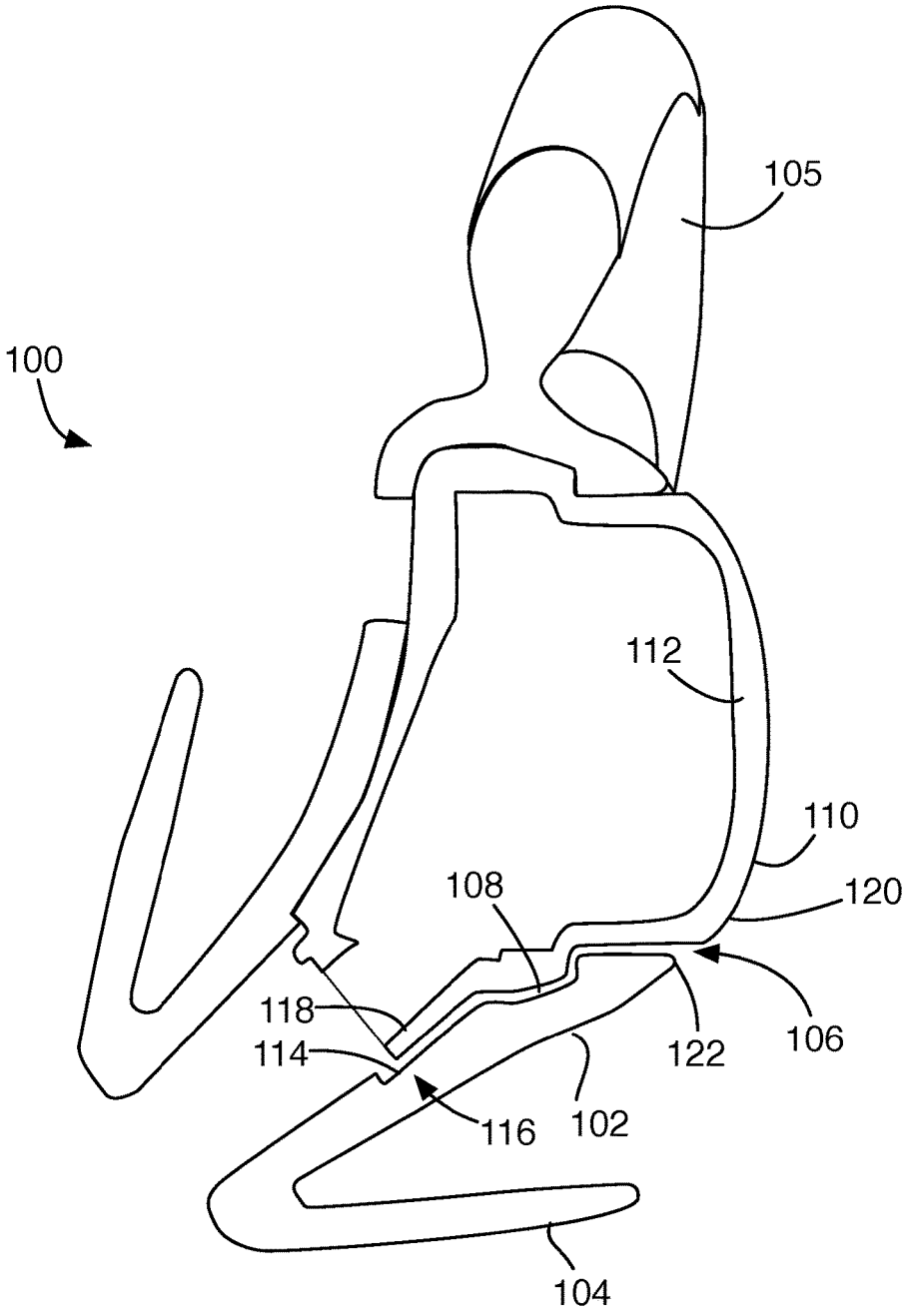
FIG. 3 shows a cross-sectional view of the earphone of FIG. 1.

In one example, as shown in FIGS. 1-3, an earphone 100 includes an ear tip 102 with a flange 104 that is designed to block the entrance to the user's ear canal when worn. Such an ear tip is described in U.S. Pat. No. 8,737,669, titled Earpiece Passive Noise Attenuating, the entire contents of which are incorporated here by reference. This ear tip design advantageously blocks a large amount of external sound from entering the ear, but does cause a noticeable occlusion effect. A retaining feature 105 helps the earphone stay in the ear.

The earphone may include other components, such as an electroacoustic transducer, also called a speaker or driver, electronics, and a battery, not shown, contained within the earphone body, or housing, 112, better seen in FIG. 2, in which the ear tip is removed. In general, a radiating surface of the transducer will be coupled to air inside the nozzle of the earphone, through which it reaches the ear canal. If the transducer is inside the main bulk of the housing (as opposed to being located directly in the nozzle), a volume of air inside the housing may come between the radiating surface and the end of the nozzle; this is referred to as a front volume, cavity, or chamber. Depending on the type of transducer used, there may also be a rear volume between an opposite radiating surface of the transducer and the back side of the housing. The front and rear chambers may be ported to air outside the earphone, as described in U.S. Pat. Nos. 7,916,888 and 8,594,351, titled In-Ear Headphones and Equalized Earphones, respectively, the entire contents of which are incorporated here by reference.

To relieve the occlusion effect caused by the ear tip flange, a PEQ port 106 is formed by providing a groove 108 on an outer surface 110 of the earphone body 112. When the ear tip 102 is installed around the earphone body 112, the inner mating surface 114 of the ear tip closes the open side of the groove, creating a tube that runs from the inner end 116 of the outlet nozzle 118 of the earphone to the back end 120 of the earphone, where it is coupled to free space. One advantage of placing the groove in the earphone body rather than in the ear tip is that the rigid body of the earphone assures that the dimensions of the port remain as designed, whereas a port through the flexible ear tip may be deformed by external pressure, changing its acoustic behavior.

In some examples, the groove is less than 1 mm wide and less than 1 mm deep. It can be square or half-round in cross-section, or other shapes, as manufacturing technology may dictate. As seen in FIG. 3, the length of the groove depends on the total size of the ear bud, that is, the length of the groove is dictated by the distance between the end 116 of the nozzle 118 on the ear bud and the outer edge 122 of the ear tip 102, where the groove exits to free space. A typical distance will be around 5 to 15 mm. In general, because the PEQ port is long and skinny, it will have a high acoustic impedance at higher frequencies, and a low acoustic impedance at low frequencies. In particular, at such small dimensions, a port will have a generally constant impedance below around 200 Hz, and impedance will increase linearly with frequency above that.

Figure 4:
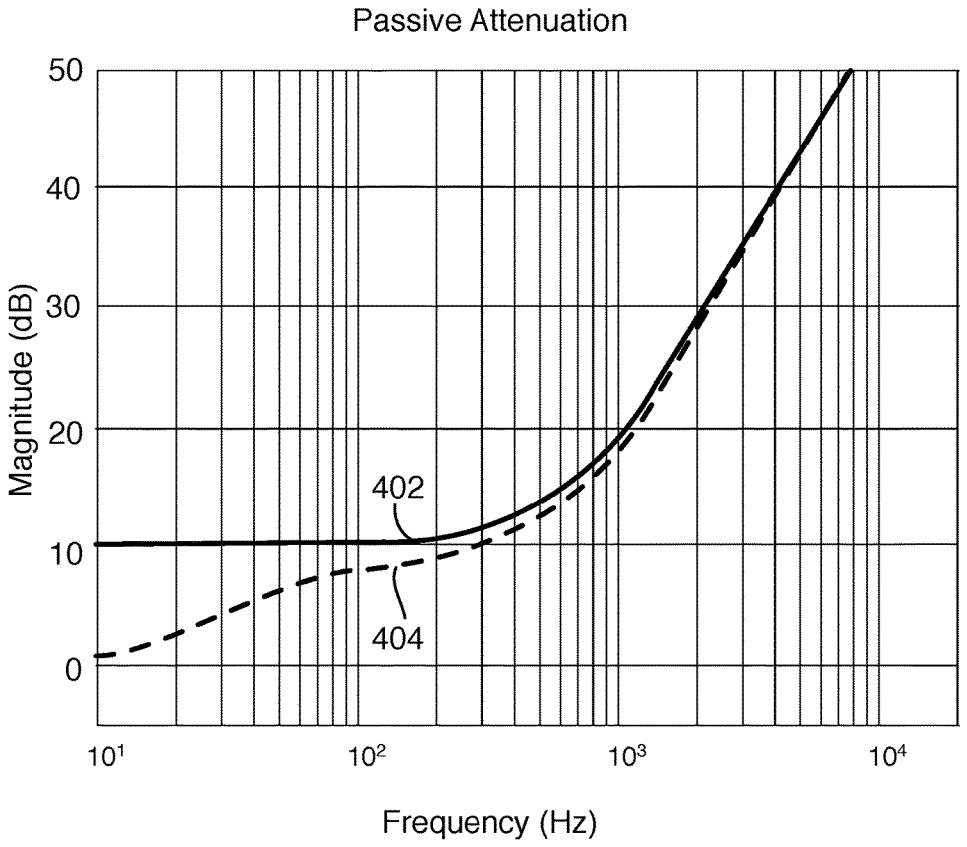
FIG. 4 shows a graph of passive attenuation.

In one example, such a PEQ port behaves acoustically as shown in the graph in FIG. 4. The port in this example has an equivalent radius of 0.17 mm and a length of 7 mm. This results in an acoustic impedance of $3.9\times10^8$ Pa·s/m$^3$ below 200 Hz, and of $8.7\times10^8$ Pa·s/m$^3$ at 1 kHz. The graph shows the resulting passive attenuation of the earbud with and without the port. The solid line 402 shows the modeled passive attenuation of the ear bud without the port, and with a good fit, i.e., one without a leak between the ear tip and the ear canal. This bud has a constant attenuation below about 200 Hz. With the port, shown in the dashed line 404, the attenuation continues to decrease with lower frequencies, reaching nearly zero at 10 Hz.

This is ideal for its purpose, as it will be able to relieve the pressure of insertion (which is effectively a very-low-frequency event), but will not detract from the overall sealed nature of the earphones at higher frequencies. In addition, because the depth of the groove is less than the thickness of the plastic forming the shell of the ear bud, it does not add any volume to the ear bud, allowing the ear bud to be as small as possible given all its other components and requirements.

FIGS. 5, 6, 7, and 8 show how the inner end of the PEQ port 106 may be protected against intrusion by ear wax or other foreign material, which could block the port. A screen 202 covers the end of the nozzle 118, to prevent foreign material from entering into the earphone body and interfering with the operation of the earphone. The screen may also provide an acoustic resistance, as part of the acoustic design of the earphone. In general, the screen may be attached to the earbud body around the perimeter of the nozzle, by gluing, heat-staking, or other appropriate methods of attachment.

Figure 5:
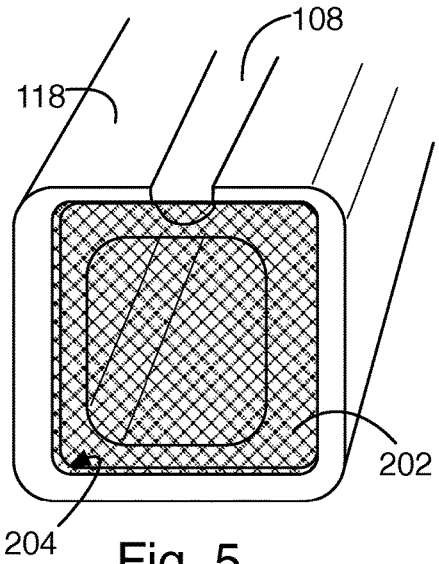
FIGS. 5 through 8 show perspective views of the end of the nozzle of the earphone of FIG. 1.
Figure 6:
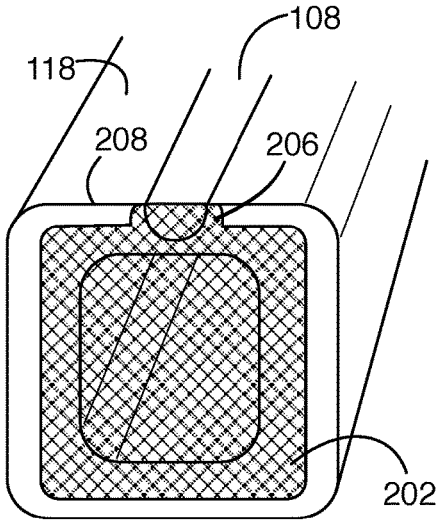
Figure 7:
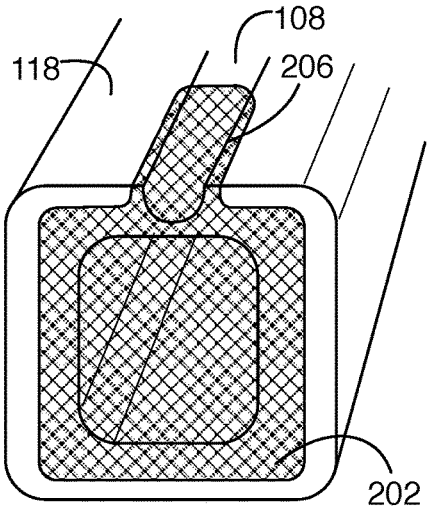
Figure 8:
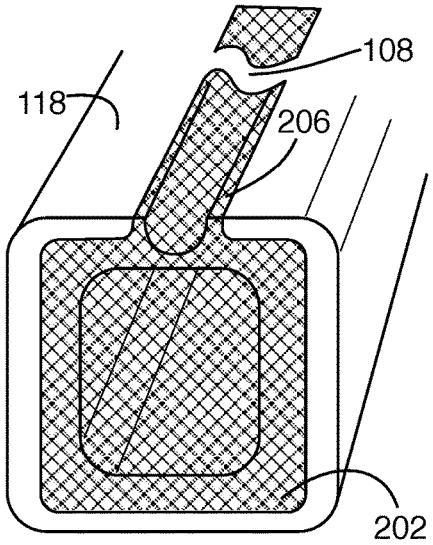

At a minimum, as shown in FIG. 5, the screen 202 covers the end of the groove 108 where the depth of the groove into the wall of the nozzle 118 goes beyond the edge of the screen. In the example of FIG. 5, the screen is located in a depression 204 in the end of the nozzle. In some examples, to better protect the PEQ port, the screen is extended at the location of the groove, as shown in FIG. 6, so that the extension 206 reaches the inner edge 208 of the nozzle where it meets the ear tip (not shown) and covers the entire end of the PEQ port. In the example of FIG. 6, the screen is flush on the end surface of the nozzle. In other examples, the screen extends more and the extension 206 is folded over the end of the nozzle at the location of the groove, so that it covers the first few millimeters of the groove, as shown in FIG. 7. In some examples, as shown in FIG. 8, the screen may be extended farther along the groove, up to going the entire length of the groove and even covering the rear exit. The screen may be attached to the surface of the nozzle on either side of the groove in the same manner that it is attached around the perimeter of the nozzle's opening.

In addition to providing a more secure attachment and preventing debris from getting around the edge of the screen, this has a further advantage of propping up the ear tip where it covers the end of the groove, preventing external pressure on the ear tip from pinching the PEQ port closed at this point. The ear tip may also be prevented from pinching the PEQ port closed by using a harder material on the inner surface than is used for the external surfaces of the ear tip, as described in U.S. Pat. No. 8,355,522, the entire contents of which are incorporated here by reference. In many cases, however, the groove is small enough that even a soft ear tip material will not be easily pressed into the groove.

Figure 9:
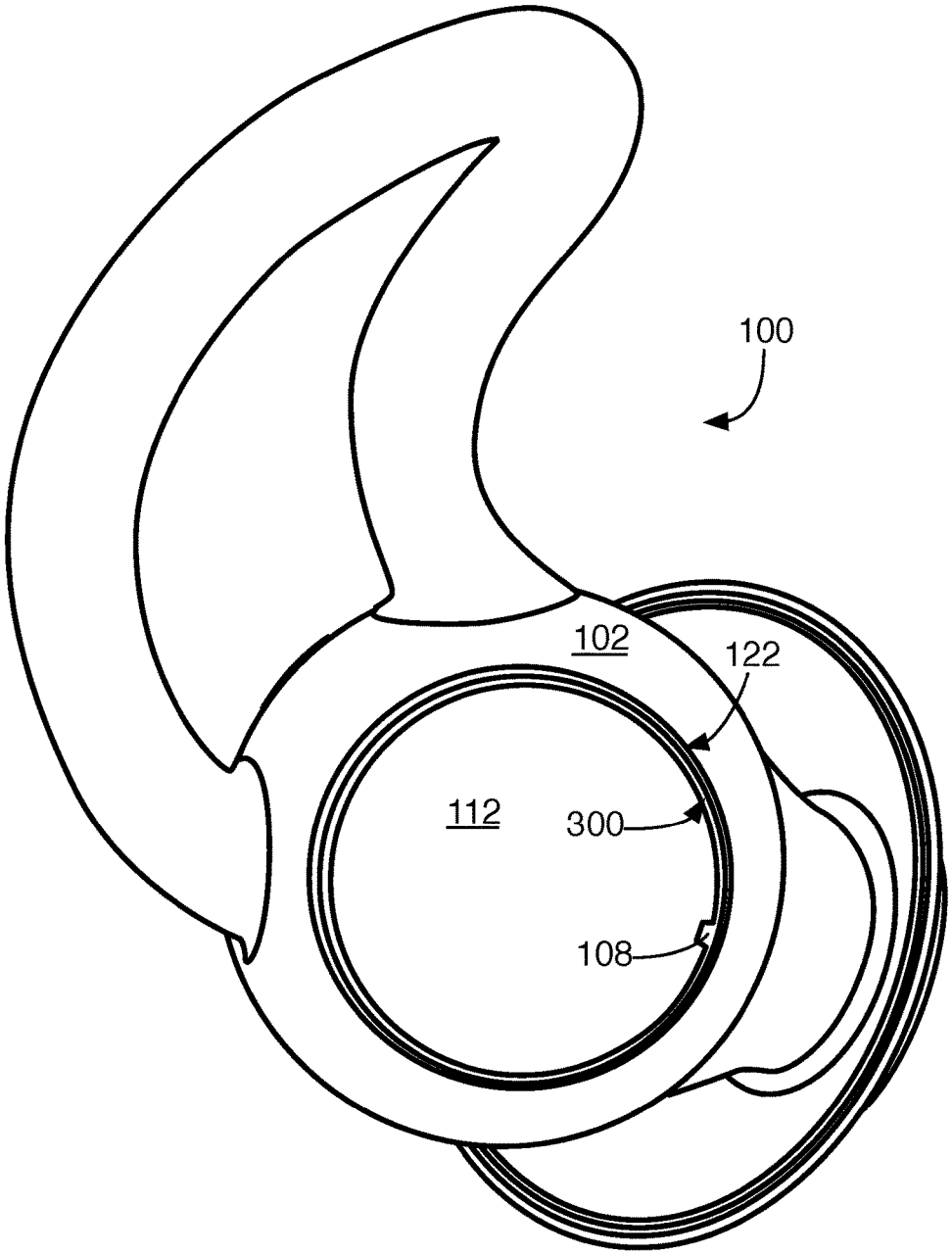
Figure 10:
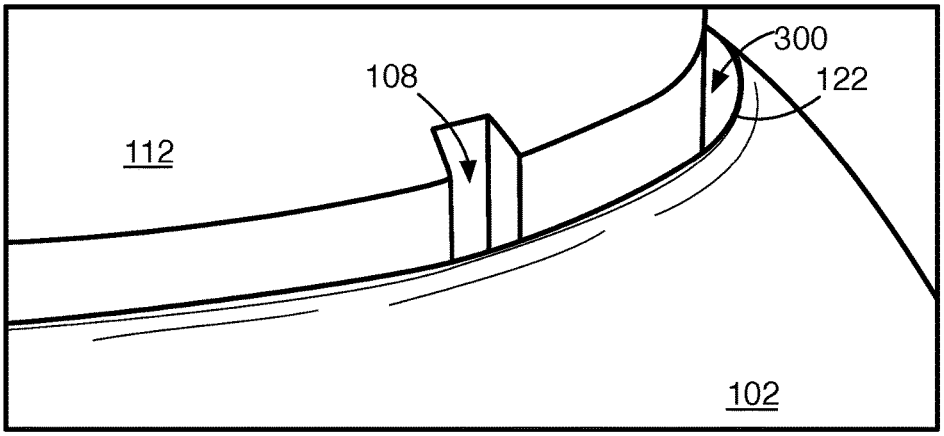
FIG. 10 shows a perspective view of a detail of the earphone of FIG. 1.
Figure 11:
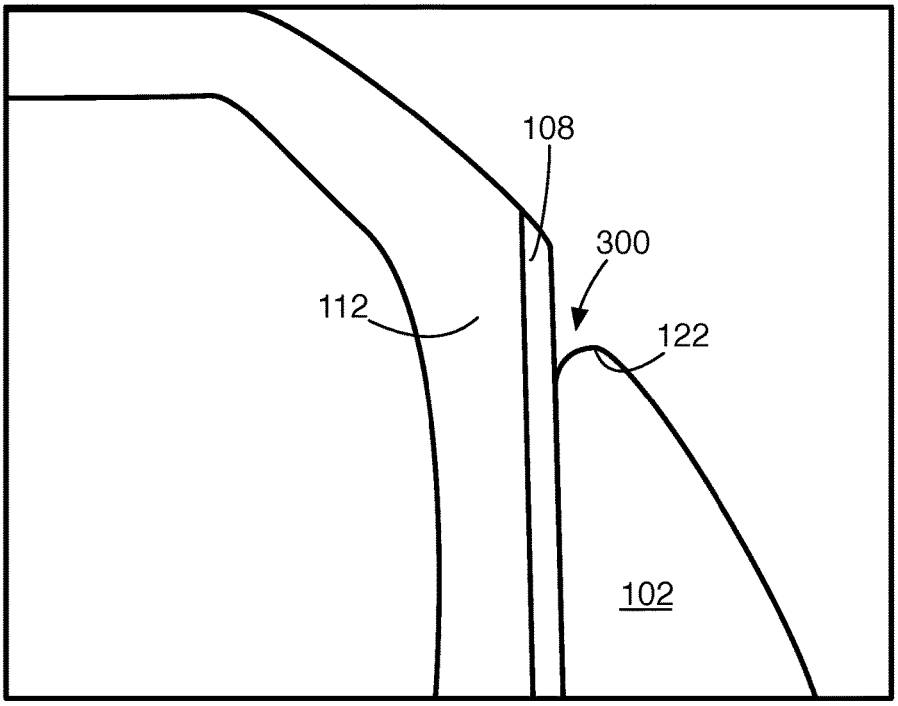
FIG. 11 shows a cross-sectional view of the detail shown in FIG. 10.

At the other end of the groove, where it exits the earbud into free space, an additional feature, as shown in FIGS. 9, 10, and 11 may be used to prevent the exit from being blocked by the wearer's outer ear. In this view, the end of groove 108 is seen in the edge of the earphone body 112, where it extends beyond the ear tip 102. The edge 122 of the ear tip is rounded, as seen in the cross-sectional view of FIG. 10, so a small depression 300 is formed around the perimeter of the body. If some part of the ear, most likely the tragus, happens to lie on top of the point where groove exits, this depression 300 allows air to freely flow around the blockage and to reach free space elsewhere along the perimeter of the body.

If the screen has a non-negligible acoustic resistance, in addition to affecting the overall frequency response of the earphone by loading the nozzle, the portion covering the end or ends of the groove will also affect the contribution of the PEQ port to the frequency response of the earphone, increasing the resistance of the port. Given the groove's overall long and skinny shape, however, this additional resistance will be negligible.

A number of implementations have been described. Nevertheless, it will be understood that additional modifications may be made without departing from the scope of the inventive concepts described herein, and, accordingly, other embodiments are within the scope of the following claims.

What is claimed is:

1. An earphone comprising:

an earphone body composed of rigid material and having an outer surface, the earphone body including an inner end and an outer end, such that when the earphone is located in an ear, the inner end is located near the ear canal and the outer end faces away from the ear; and an ear tip composed of flexible material and having an inner surface corresponding in shape to at least a portion of the outer surface of the earphone body, and an outer surface configured to contact the ear and seal the ear canal when the earphone is located in the ear; wherein the ear tip covers the earphone body from a first point on the earphone body near the inner end of the earphone body to a second point on the earphone body near the outer end of the earphone body when the ear tip is positioned on the earphone body;

the earphone body includes a groove in the outer surface extending from at least a first end at the first point on the earphone body to at least a second end at the second point on the earphone body, and having an open top between the ends, such that when the ear tip is positioned on the earphone body, the groove and a portion of the ear tip inner surface facing the groove together form a hollow tube extending from the first point on the earphone body to the second point on the earphone body, the ear tip includes an opening through which the outer end of the earphone body extends, and an edge of the ear tip opening surrounding the outer end of the earphone body is rounded away from the earphone body, such that an open circumferential channel is formed between the ear tip and the earphone body, around a perimeter of the earphone body, the hollow tube formed between the groove and the inner surface of the ear tip ending in the channel.

2. The earphone of claim 1, wherein the first end of the groove is located at the inner end of the earphone body.

3. The earphone of claim 1, wherein the second end of the groove is located at the outer end of the earphone body.

4. The earphone of claim 1, wherein the groove is about 0.35 mm wide.

5. The earphone of claim 1, wherein the groove is about 0.3 mm deep.

6. The earphone of claim 1, wherein the groove has a cross-sectional area of about 0.1 $mm^2$.

7. The earphone of claim 1, wherein the groove is rectangular in cross section.

8. The earphone of claim 1, wherein the groove has a length and a cross-sectional area such that the tube formed when the groove is covered by the ear tip has an acoustic impedance of around $3.9\times10^8$ $Pa\cdot s/m^3$ below 200 Hz, and increases linearly with frequency above 200 Hz.

9. The earphone of claim 8, wherein the groove further has an acoustic impedance of around $8.7\times10^8$ $Pa\cdot s/m^3$ at 1 khz.

10. The earphone of claim 1, further comprising:

an electroacoustic transducer located inside the earphone body, a radiating surface of the transducer being acoustically coupled to an opening in the earphone body at the inner end of the earphone body.

11. The earphone of claim 10, further comprising a screen covering the opening in the earphone body, the screen extending over at least part of the first end of the groove.

12. The earphone of claim 11, wherein the first end of the groove is located at the inner end of the earphone body.

13. The earphone of claim 11, wherein the screen extends along the surface of the earphone body, covering the open top of the groove, for a first distance.

14. The earphone of claim 11, wherein the ear tip includes an opening corresponding to the opening in the earphone body, to allow sound produced by the transducer to exit the earphone.

15. An earphone comprising:

a housing enclosing an acoustic transducer and having a front volume, the housing comprising:

a nozzle that extends the front volume to at least an entrance of a wearer's ear canal, and a groove in an outer surface of the housing, extending at least along a length of the nozzle; and a flexible ear tip configured to attach to the housing; wherein when the flexible ear tip attaches to the housing, the groove and a portion of an inner surface of the ear tip together form a port that acoustically couples the front volume with an environment external to the earphone, the ear tip includes an opening through which the outer end of the earphone body extends, and an edge of the ear tip opening surrounding the outer end of the earphone body is rounded away from the earphone body, such that an open circumferential channel is formed between the ear tip and the earphone body, around a perimeter of the earphone body, the port formed between the groove and the inner surface of the ear tip ending in the channel.

16. The earphone of claim 15, wherein the groove is about 0.35 mm wide.

17. The earphone of claim 15, wherein the groove is about 0.3 mm deep.

18. The earphone of claim 15, wherein the groove has a cross-sectional area of about 0.1 $mm^2$.

19. The earphone of claim 15, wherein the groove is rectangular in cross section.

20. The earphone of claim 15, wherein the groove has a length and a cross-sectional area such that the tube formed when the groove is covered by the ear tip has an acoustic impedance of around $3.9\times10^8$ $Pa\cdot s/m^3$ below 200 Hz, and increases linearly with frequency above 200 Hz.

21. The earphone of claim 20, wherein the groove further has an acoustic impedance of around $8.7\times10^8$ $Pa\cdot s/m^3$ at 1 khz.

* * * * *